US005550012A

United States Patent [19]

Suga

[11] Patent Number: 5,550,012

[45] Date of Patent: Aug. 27, 1996

[54] SILVER HALIDE EMULSION AND SILVER HALIDE PHOTOGRAPHIC LIGHT-SENSITIVE MATERIAL USING THE SAME

[75] Inventor: Yoichi Suga, Minami/Ashigara, Japan

[73] Assignee: Fuji Photo Film Co., Ltd., Kanagawa, Japan

[21] Appl. No.: 293,606

[22] Filed: Aug. 22, 1994

Related U.S. Application Data

[63] Continuation of Ser. No. 989,936, Dec. 10, 1992, abandoned, which is a continuation of Ser. No. 619,462, Nov. 29, 1990, abandoned.

[30] Foreign Application Priority Data

Dec. 1, 1989 [JP] Japan ..... 1-310716

[51] Int. Cl.$^6$ ..... G03C 1/035

[52] U.S. Cl. ..... 430/567; 430/569; 430/603; 430/607; 430/611

[58] Field of Search ..... 430/567, 569, 430/607, 611, 603

[56] References Cited

U.S. PATENT DOCUMENTS

| | | | |
|---|---|---|---|
| 3,047,393 | 7/1962 | Herz et al. | 430/607 |
| 4,198,240 | 4/1980 | Mikawa | 430/570 |
| 4,276,374 | 6/1981 | Mifune et al. | 430/611 |
| 4,614,711 | 9/1986 | Sugimoto et al. | 430/567 |
| 4,665,012 | 5/1987 | Sugimoto et al. | 430/502 |
| 4,806,461 | 2/1989 | Ikeda et al. | 430/567 |
| 4,996,137 | 2/1991 | Inoue et al. | 430/378 |
| 5,079,138 | 1/1992 | Takada | 430/567 |
| 5,081,009 | 1/1992 | Tanemura et al. | 430/569 |

*Primary Examiner*—Janet C. Baxter
*Attorney, Agent, or Firm*—Birch, Stewart, Kolasch & Birch, LLP

[57] ABSTRACT

A silver halide emulsion contains silver halide grains in a dispersion medium. Tabular silver halide grains having a thickness of less than 0.5 μm, a diameter of 0.3 μm or more, an aspect ratio of 2 or more, and 10 or more dislocations per grain account for 50% or more of a projected area of all the silver halide grains. The grains are formed in the presence of at least one compound which can oxidize silver atoms.

19 Claims, No Drawings

SILVER HALIDE EMULSION AND SILVER HALIDE PHOTOGRAPHIC LIGHT-SENSITIVE MATERIAL USING THE SAME

This application is a continuation of application Ser. No. 07/989,936 filed on Dec. 10, 1992, now abandoned, which is a continuation of application Ser. No. 07/619,462 filed, Nov. 29, 1990, now abandoned.

BACKGROUND OF THE INVENTION

1. Field of the Invention

The present invention relates to a silver halide emulsion and to a silver halide photographic light-sensitive material and, more particularly, to a photographic light-sensitive material containing a tabular silver halide emulsion having improved photographic properties and an improved resistance to pressure.

2. Description of the Related Art

In general, various types of pressures are applied onto a photographic light-sensitive material in which a silver halide emulsion is coated. For example, a photographic negative film for a general purpose is bent when it is taken up by a user or loaded in a camera, or pulled upon winding of a frame.

A sheet-like film such as a printing light-sensitive material or a direct medical roentgen light-sensitive material is directly handled by a human hand. Therefore, such a film is often bent.

In addition, all light-sensitive materials are subjected to a high pressure upon cutting or processing.

When various types of pressures are applied on a photographic light-sensitive material as described above, silver halide grains are pressurized via gelatin as a carrier (binder) of the silver halide grains or a plastic film as a support. It is known that photographic properties of a photographic light-sensitive material are changed when a pressure is applied on silver halide grains, and this is reported in detail in, e.g., K. B. Mather, J. Opt. Soc. Am., 38. 1054 (1948). P. Faelens and P.de Smet. Sci. et Ind Phot., 25. No. 5. 178 (1954). P. Faelens. J. Phot. Sci. 2. 105 (1954).

In recent years, a strict demand has arisen for a photographic silver halide emulsion, i.e., a demand has arisen for higher levels of toughness such as storage stability and a resistance to pressure in addition to photographic properties such as sensitivity and image quality, e.g., graininess and sharpness. However, it is obvious that pressure marks are increased as sensitivity is increased. Therefore, a demand has arisen for an emulsion having high sensitivity with less pressure marks. JP-A-63-220228 ("JP-A" means unexamined published Japanese patent application) discloses tabular grains having improved exposure intensity dependency, storage stability, and resistance to pressure. However, pressure marks caused by scratching in a camera or by scratching by a nail are not satisfactorily improved.

SUMMARY OF THE INVENTION

It is an object of the present invention to provide a silver halide emulsion having high sensitivity and a high resistance to pressure and a photographic light-sensitive material using the same.

The present inventors have made extensive studies and found that the object of the present invention can be achieved by the following means.

(1) A silver halide emulsion containing silver halide grains in a dispersion medium, wherein tabular silver halide grains having a thickness of less than 0.5 μm, a diameter of 0.3 μm or more, an aspect ratio of or more, and 10 or more dislocations per grain account for 50% or more of a projected area of all the silver halide grains, and the grains are formed in the presence of at least one type of a compound which can oxidize silver atoms.

(2) A silver halide photographic light-sensitive material having at least one silver halide emulsion layer on a support, wherein the silver halide emulsion layer contains an emulsion in which tabular silver halide grains having a thickness of less than 0.5 μm, a diameter of 0.3 μm or more, an average aspect ratio of 2 or more, and 10 or more dislocations per grain account for 50% or more of a projected area of all the silver halide grains and the grains are formed in the presence of at least one type of a compound which can oxidize silver atoms.

(3) A silver halide emulsion containing silver halide grains in a dispersion medium, wherein tabular silver halide grains having a thickness of less than 0.5 μm, a diameter of 0.3 μm or more, an aspect ratio of 2 or more, and 10 or more dislocations per grain account for 50% or more of a projected area of all the silver halide grains and the grains are formed in the presence of at least one compound represented by formulas (I), (II), and (III):

$$R—SO_2SM \quad (I)$$

$$R—SO_2S—R^1 \quad (II)$$

$$R—SO_2S—L_m—SSO_2—R^2 \quad (III)$$

wherein R, $R^1$, and $R^2$ may be the same or different and independently represent an aliphatic group, an aromatic group, or a heterocyclic group, M represents an anion, L represents a divalent coupling group, and m represents 0 or 1. Compounds represented by formulas (I) to (III) may be polymers containing divalent groups derived from structures represented by formulas (I) to (III) as repeating units. If possible, R, $R^1$, $R^2$, and L may be bonded to form a ring.

(4) A photographic light-sensitive material having at least one silver halide emulsion layer on a support, wherein the silver halide emulsion layer contains a silver halide emulsion in which tabular silver halide grains having a thickness of less than 0.5 μm, a diameter of 0.3 μm or more, an average aspect ratio of 2 or more, and 10 or more dislocations per grain account for 50% or more of a projected area of all the silver halide grains and the grains are formed in the presence of at least one compound represented by formulas (I), (II), and (III):

$$R—SO_2SM \quad (I)$$

$$R—SO_2S—R^1 \quad (II)$$

$$R—SO_2S—L_m—SSO_2—R^2 \quad (III)$$

wherein R, $R^1$, and $R^2$ may be the same or different and independently represent an aliphatic group, an aromatic group, or a heterocyclic group, M represents an anion, L represents a divalent coupling group, and m represents 0 or 1. Compounds represented by formulas (I) to (III) may be polymers containing divalent groups derived from structures represented by formulas (I) to (III) as repeating units. If possible, R, $R^1$, $R^2$, and L may be bonded to form a ring.

DETAILED DESCRIPTION OF THE INVENTION

In the present invention, the tabular silver halide grain (to be referred to as a "tabular grain" hereinafter) means a grain having two opposing parallel faces in which a circle-equivalent diameter d of the face (a diameter of a circle having the same projected area as that of the face) is twice or more a distance a (i.e., a thickness) between the two faces. An aspect ratio of this grain is d/a.

An average aspect ratio of an emulsion having the tabular grains of the present invention is preferably 2 to 12, and more preferably, 5 to 8.

The average aspect ratio can be obtained by averaging aspect ratios of all the tabular grains.

A (circle-equivalent) diameter of the tabular grains of the present invention is 0.3 to 4 μm, preferably, 0.5 to 4 μm, and more preferably, 0.5 to 2.0 μm. A grain thickness is less than 0.5 μm, preferably, 0.05 to 0.5 μm, and more preferably, 0.08 to 0.3 μm.

In the present invention, the grain diameter or thickness can be measured from an electron micrograph of grains as in a method described in U.S. Pat. No. 4,434,226.

A halogen composition of the tabular grains is preferably silver iodobromide, silver chlorobromide, or silver chloroiodobromide, and most preferably, silver iodobromide containing 0.1 to 20 mol %, and preferably, 1 to 10 mol %, of silver iodide.

A dislocation of a tabular grain can be observed by a direct method using a cryo-transmission electron microscope as described in, e.g., J. F. Hamilton, Phot. Sci. Eng., 11. 57. (1967) or T. Shiozawa, J. Soc. Phot. Sci. Japan, 35. 213. (1972). That is, a silver halide grain extracted from an emulsion so as not to apply a pressure which produces a dislocation in the grain is placed on a mesh for electron microscope observation, and observation is performed by a transmission method while a sample is cooled to prevent damage (e.g., print out) caused by electron rays. In this case, since it becomes difficult to transmit electron rays as the thickness of a grain is increased, the grain can be observed more clearly by using a high-voltage (200 kV or more with respect to a grain having a thickness of 0.25 μm) electron microscope. By using photographs of grains obtained by this method, the positions and number of dislocations of each grain vertically viewed with respect to the major face can be obtained.

Dislocations of the tabular grain of the present invention are produced in an area from x % of a distance, along the major axis of the tabular grain, between the center and the edge of the grain to the edge. The value of x is preferably $10 \leqq x < 100$, more preferably, $30 \leqq x < 98$, and most preferably, $50 \leqq x < 95$. Although a shape obtained by connecting positions from which the dislocations start is generally similar to the shape of the grain, it is sometimes not a perfect similar figure but is distorted.

The dislocation of the present invention means a dislocation extending in a (211) direction from the center to the edge.

As for the number of dislocations of the tabular grains of the present invention, it is preferred that grains containing 10 or more dislocations account for 50% or more of the total projected area. More preferably, grains containing 10 or more dislocations account for 80% or more of the total projected area, and most preferably, grains containing 20 or more dislocations account for 80% or more of the area.

A method of preparing the tabular grains will be described below.

The tabular grain manufacturing method can be obtained by arbitrarily combining methods known to those skilled in the art.

For example, it can be obtained by forming seed crystals in which the tabular grains are present in an amount of 40% or more (weight) in a comparatively high-pAg atmosphere having a pBr of 1.3 or less and growing the seed crystals by adding silver and halide solutions while the pBr value is kept at the above value or more.

In the grain growth process in which one or both of a silver salt and a halide are added, the silver and halide solutions are preferably added so as not to produce new crystal nuclei.

The size of the tabular grains can be adjusted by adjusting the temperature., selecting the type or amount of a solvent, or controlling the addition speed of a silver salt and a halide used in grain growth.

Dislocations of the tabular grain of the present invention can be controlled by forming a specific high silver iodide containing region (high iodide region) in the grain. More specifically, substrate grains are prepared, a high iodide region is formed by the following method ①, ②, or ③, and the formed high iodide region is covered with a region having a silver iodide content lower than that of the high iodide region.

The silver iodide content of the substrate tabular grain is lower than that of the high iodide region, preferably, 0 to 12 mol %,, and more preferably, 0 to 10 mol %.

The internal high iodide region is a silver halide solid solution containing silver iodide at a comparatively high content. The silver halide is preferably silver iodide, silver iodobromide, or silver chloroiodobromide, more preferably, silver iodide or silver iodobromide (silver iodide content=10 to 40 mol %,), and most preferably, silver iodide.

It is important to form the internal high iodide region not uniformly but locally on the surface of the substrate tabular grain. Such localization may be performed on any of a major face, a side face, an edge, or a corner of the tabular grain. Alternatively, the region may be located epitaxially, selectively on such a site.

① For this purpose, a so-called conversion method as described in E. Klein, E. Moisar, G. Murch, Phot. Korr., 102, (4), 59 to 63, (1966) can be used. In this method, during grain formation, halide ions, which solubility of salt for forming silver ions lower than that of halide ions which form grains (or portions near the surfaces of grains) at the moment, may be added. In the present invention, an amount of the halide ions having lower solubility to be added is preferably a certain value (depending on a halogen composition) or more with respect to the surface area of the grains at the moment. For example, during grain formation, a certain amount or more of KI with respect to the surface area of AgBr grains at the moment is preferably added. More specifically, $8.2 \times 10^{-5}$ mol/m$^2$or more of KI is preferably added.

② An epitaxial junction method as described in JP-A-59-133540, JP-A-58-108526, or JP-A-59-162540 can be used. In this method, a site director for epitaxial growth such as an adsorptive spectral sensitizing dye can be used. The internal high iodide region of the present invention can be formed by adding the site directors or selecting grain growth conditions (e.g., a pAg, a pH, and a temperature), in adding a silver salt solution and a halide solution containing iodide.

③ The internal high iodide region can be formed by adding fine silver iodide grains upon formation of tabular grains. The sphere-equivalent diameter of the fine silver iodide grains is 0.3 μm or less, and preferably, 0.1 μm or less.

The silver iodide content of the outer region for covering the high iodide region is lower than that of the high iodide region, preferably, 0 to 12 mol %,, more preferably, 0 to 10 mol %,, and most preferably, 0 to 3 mol %,.

The internal high iodide region is preferably present in an annular region about the center of a tabular grain, the annular region falling within the range of preferably 5 to 80 mol %,, more preferably, 10 to 70 mol %,, and most preferably, 20 to 60 mol %, from the grain center with respect to the major axis direction of the grain.

In this case, the major axis direction of the grain is defined as the direction of diameter of the tabular grain, and the minor axis direction is defined as the direction of thickness of the tabular grain.

The silver iodide content of the internal high iodide region is preferably higher than the average silver iodide content of silver bromide, silver iodobromide, or silver chloroiodobromide present on the surface of the grain, more preferably, five times or more, and most preferably, 20 times or more the average silver iodide content.

An amount of a silver halide for forming the internal high iodide region is preferably 50 mol %, or less (silver amount), more preferably, 10 mol %, or less, and most preferably, 5 mol %, or less of a silver amount of the entire grain.

A method of increasing the addition speed, the addition amount, and the addition concentration of the silver salt solution (e.g., an aqueous $AgNO_3$ solution) and the halide solution (e.g., an aqueous KBr solution) to be added in order to accelerate grain growth during manufacture of the tabular grains of the present invention is preferably used.

These methods are described in, e.g., British Patent 1,335,925, U.S. Pat. Nos. 3,672,900, 3,650,757, and 4,242,445, JP-A-55-142329, and JP-A-55-158124.

A silver halide solvent can be effectively used to promote ripening. For example, in a known conventional method, an excessive amount of halogen ions are supplied in a reaction vessel in order to promote ripening. Therefore, it is apparent that ripening can be promoted by only supplying a halide salt solution into a reaction vessel. In addition, another ripening agent can be used. In this case, a total amount of these ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added alone during a halide and silver salt adding step.

Examples of the ripening agent other than the halogen ion are ammonia, an amine compound and a thiocyanate such as an alkali metal thiocyanate, especially sodium or potassium thiocyanate and ammonium thiocyanate. The use of a thiocyanate ripening agent is described in U.S. Pat. Nos. 2,222,264, 2,448,534, and 3,320,069- In addition, a thioether ripening agent which is normally used as described in U.S. Pat. Nos. 3,271,157, 3,574,628, and 3,737,313 can be used. Also, a thione compound as disclosed in JP-A-53-82408 and JP-A-53-144319 can be used.

In the tabular grain used in the present invention, a silver halide having different compositions may be bonded by an epitaxial junction, or a compound other than a silver halide such as silver rhodanate or zinc oxide may be bonded. These emulsion grains are disclosed in, e.g., U.S. Pat. Nos. 4,094,684, 4,142,900, and 4,459,353, British Patent 2,038,792, U.S. Pat. Nos. 4,349,622, 4,395,478, 4,433,501, 4,463,087, 3,656,962, and 3,852,067, and JP-A-59-162540.

The tabular grains of the present invention are normally, subjected to chemical sensitization.

Chemical sensitization can be performed by using active gelatin as described in T. H. James, "The Theory of the Photographic Process", 4th ed., Macmillan, 1977, PP. 67 to 76. Alternatively, chemical sensitization can be performed at a pAg of 5 to 10, a pH of 5 to 8 and a temperature of 30° to 80° C. by using sulfur, selenium, tellurium, gold, platinum, palladium or iridium, or a combination of a plurality of these sensitizers as described in Research Disclosure Vol. 120, No. 12,008 (April, 1974), Research Disclosure Vol. 34, No. 13,452 (June, 1975), U.S. Pat. Nos. 2,642,361, 3,297,446, 3,772,031, 3,857,711, 3,901,714, 4,266,018, and 3,904,415, and British Patent 1,315,755. Chemical sensitization is optimally performed in the presence of a gold compound and a thiocyanate compound, or a sulfur-containing compound described in U.S. Pat. Nos. 3,857,711, 4,266,018 and 4,054,457 or a sulfur-containing compound such as a hypo, thiourea compound and a rhodanine compound. Chemical sensitization can also be performed in the presence of a chemical sensitization aid. Examples of the chemical sensitization aid are compounds known to suppress fogging and increase sensitivity in the chemical sensitization process such as azaindene, azapyridazine, and azapyrimidine. Examples of a chemical sensitization aid modifier are described in U.S. Pat. Nos. 2,131,038, 3,411,914, 3,554,757, JP-A-58-126526 and G. F. Duffin, "Photographic 10 Emulsion Chemistry", PP. 138 to 143. In addition to or in place of the chemical sensitization, reduction sensitization can be performed by using, e.g., hydrogen as described in U.S. Pat. Nos. 3,981,446 and 3,984,249, or reduction sensitization can be performed by using stannous chloride, thiourea dioxide, polyamine, or the like reducing agent or by performing a low pAg (e.g., less than 5) and/or high pH (e.g., larger than 8) treatment as described in U.S. Pat. Nos. 2,518,698, 2,743,182, and 2,743,183. Alternatively, a spectral sensitizing property can be improved by chemical sensitization methods described in U.S. Pat. Nos. 3,917,485 and 3,966,476.

A sensitization method using an oxidizing agent described in JP-A-61-3134 or JP-A-61-3136 can be applied.

As a dispersion medium, a hydrophilic dispersion medium, especially, a gelatin (a lime-processed gelatin or a acid-processed gelatin) is preferably used. In addition, a gelatin derivative such as a phthalated gelatin, albumin, and polyvinyl alcohol can be used.

In the present invention, an oxidizing agent or a compound which can oxidize silver is assumed to have the following effect. The present invention, however, is not limited by this assumption.

That is, if reduction sensitization performed in the manufacture of emulsion is not controlled, unstable silver nuclei or fog silver nuclei are undesirably produced. In addition, silver nuclei unexpectedly produced during grain formation are unstable and therefore assumed to degrade storage stability or response to pressure. Therefore, in order to form an emulsion having good storage stability, a low response to pressure, and high sensitivity, it is assumed that all of unexpected silver nuclei are preferably oxidized in the presence of an oxidizing agent of the present invention or a compound represented by a formula (I), (II), or (III) to form only controlled silver nuclei.

Examples of an oxidizing agent which can be used in the present invention are an inorganic oxidizing agent and an organic oxidizing agent.

More specifically, examples of the oxidizing agent are as follows.

Examples of the inorganic oxidizing agent are hydrogen peroxide (aqueous), an adduct of hydrogen peroxide (e.g., $NaBO_2.H_2O_2.3H_2O$, $2Na_2CO_3.3H_2O_2$, $Na_4P_2O_7.2H_2O_2$, and $2Na_2SO_4.H_2O_2.2H_2O$), a peroxoate (e.g., $K_2S_2O_8$, $K_2C_2O_6$, and $K_4P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2O_4)_2].6H_2O$), a permanganate (e.g., $KMnO_4$), a chromate (e.g., $K_2Cr_2O_7$), potassium hexacyanoferrate (II), potassium periodate, p-quinone and salts of perhaloic acid e.g. periodate. An example of the organic oxidizing agent is an organic peroxide (e.g., peracetic acid and perbenzoic acid).

In addition, an oxidizing gas (e.g., ozone and oxygen gas), an oxidizing compound releasing halogen (e.g., sodium hypochlorite, N-bromosuccinimide, chloramine B (sodium benzenesulfonechloramide), and an oxidizing compound such as chloramine T (sodium paratoluenesulfonechloramide).

Compounds represented by formulas (I), (II), and (III) will be described in more detail below. When each of R, $R^1$, and $R^2$ represent an aliphatic group, it represent preferably an alkyl group having 1 to 22 carbon atoms, an alkenyl group having 2 to 22 carbon atoms, or an alkynyl group. These groups may have a substituent group. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl group are allyl and butenyl.

Examples of the alkynyl group are propargyl and butynyl.

An aromatic group of R, $R^1$, and $R^2$ preferably has 6 to 20 carbon atoms. Examples of such an aromatic group are phenyl and naphthyl. These groups may have a substituent group.

Example of a heterocyclic group of R, $R^1$, and $R^2$ is a 3- to 15-membered ring having at least one element of nitrogen, oxygen, sulfur, selenium, and tellurium. Examples of the heterocyclic group are pyrrolidine, piperidine, pyridine, tetrahydrofurane, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole.

Examples of the substituent group of R, $R^1$, and $R^2$are an alkyl group (e.g., methyl, ethyl, and hexyl), an alkoxy group (e.g., methoxy, ethoxy, and octyloxy), an aryl group (e.g., phenyl, naphthyl, and tolyl), a hydroxy group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butyryl, and a valeryl), a sulfonyl group (e.g., methylsulfonyl and phenylsulfonyl), an acylamino group (e.g., acetylamino and benzoylamino), a sulfonylamino group (e.g., methanesulfonylamino and benzsulfonylamino), an acyloxy group (e.g., acetoxy and benzoxy), a carboxyl group, a cyano group, a sulfo group, and an amino group.

L is preferably a divalent aliphatic group or a divalent aromatic group. Examples of the divalent aliphatic group of L are $-(CH_2)_n-$ (n=1 to 12), $-CH_2-CH=CH-CH_2-$, $-CH_2C=CCH_2-$,

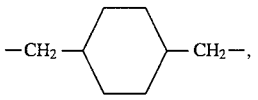

and a xylylene group. Examples of the divalent aromatic group of L are phenylene and naphthylene.

These substituent groups may be further substituted with the abovementioned substituent groups.

M represent preferably a metal ion or an organic cation. Examples of the metal ion are a lithium ion, a sodium ion, and a potassium ion. Examples of the organic cation are an ammonium ion (e.g., ammonium, tetramethylammonium, and tetrabutylammonium), a phosphonium ion (tetraphenylphosphonium), and a guanidine group.

Although examples of a compound represented by formula (I), (II), or (III) are listed in Table A, these compounds is not limited to these examples.

A compound represented by formula (I) can be easily synthesized by methods described in JP-A-54-1019 and British Patent 972,211.

The oxidizing agent or a compound represented by formula (I), (II), or (III) of the present invention is added in an amount of preferably $10^{-7}$ to $10^{-1}$, more preferably, $10^{-6}$ to $10^{-2}$, and most preferably, $10^{-6}$ to $10^{-3}$ mol/mol Ag per mol of a silver halide.

In order to add the oxidizing agent or compounds represented by formulas (I) to (III) during manufacturing steps, a method normally used in order to add additives to a photographic emulsion can be used. For example, a water-soluble compound may be added in the form of aqueous solution having an arbitrary concentration, and a compound which cannot be dissolved or is hardly dissolved in water is dissolved in an organic solvent which is miscible with water, e.g., an alcohol, a glycol, a ketone, an ester, and an amide and which does not adversely affect photographic properties, and added as a solution.

"Formed in the presence of the oxidizing agent or a compound represented by formula (I), (II), or (III) of the present invention" means that these compounds are present during at least a part of the grain formation process. That is, before the silver halide emulsion grain formation process is finished, the oxidizing agent or a compound represented by formula (I), (II), or (III) is added to the silver halide emulsion.

Although the compound can be added at any timing during grain formation, it is preferably added before two thirds portion of total water-soluble silver salt necessary to complete silver halide formation is added, i.e., before the grains are grown to have a ⅔ volume of a completed grain volume, and more preferably, before the grains are grown to have a ⅓ volume thereof.

In the present invention, the most preferable compound is a compound represented by formula (I).

A silver halide emulsion of the present invention is generally spectrally sensitized and it is preferable to perform spectral sensitization.

A methine dye is normally used as a spectral sensitizing dye in the present invention. The methine dye includes a cyanine dye, a merocyanine dye, a complex cyanine dye, a complex merocyanine dye, holopolar cyanine dye, a hemicyanine dye, a styryl dye, and a hemioxonol dye. Any nucleus which is normally used as a basic heterocyclic nucleus in a cyanine dye can be applied to these dyes. Examples of a nucleus are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nuclei obtained by fusing an aliphatic hydrocarbon ring to these nuclei; and nuclei obtained by fusing an aromatic hydrocarbon ring to these nuclei, i.e., an indolenine nucleus, a benzindolenine nucleus, an indole nucleus, a benzoxadole nucleus, a naphthooxadole nucleus, a benzothiazole nucleus, a naphthothiazole nucleus, a benzoselenazole nucleus, a benzimidazole nucleus, and a quinoline nucleus. These nuclei can be substituted on a carbon atom.

A 5- or 6-membered heterocyclic nucleus can be applied as a nucleus having a ketomethylene structure to a merocyanine dye or a complex merocyanine dye. Examples of such a nucleus are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

In addition to the above dyes, dyes which can be used as a spectral sensitizing dye are described in, for example, West German Patent 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, and 4,026,707, British Patents 1,242,588, 1,344,281, and 1,507,803, JP-B-44-14030, JP-B-52-24,844, JP-B-43-4936, JP-B-53-12375, JP-A-52-110618, JP-A-52-109925, and JP-A-50-80827.

The light-sensitive material of the present invention need only have at least one of a blue-sensitive silver halide emulsion layer, a green-sensitive silver halide layer, and a red-sensitive silver halide layer formed on a support. The number or order of the silver halide emulsion layers and the non-light-sensitive layers are particularly not limited. A typical example is a silver halide photographic light-sensitive material having, on a support, at least one light-sensitive layer constituted by a plurality of silver halide emulsion layers which are sensitive to essentially the same color but have different sensitivities. In a multilayered silver halide color photographic light-sensitive material, unit light-sensitive layers are generally formed such that red-, green-, and blue-sensitive layers are arranged from a support in the order named. However, this order may be reversed or a layer sensitive to one color may be sandwiched between layers sensitive to another color in accordance with an application.

In order to improve color reproducibility, in addition to light-sensitive layers sensitive to conventional three colors, i.e., blue, green, and red, light-sensitive layers sensitive to the fourth or more colors may be formed. Such a layer arrangement is described in JP-A-61-34541, JP-A-61-201245, JP-A-61-198236, or JP-A-62-160448. In this case, the light-sensitive layers sensitive to fourth or more colors may be arranged at arbitrary positions. In addition, each of the light-sensitive layers sensitive the fourth or more colors may be constituted by a single or a plurality of layers.

Non-light-sensitive layers such as various types of interlayers may be formed between the silver halide light-sensitive layers and as an uppermost layer and a lowermost layer.

The interlayer may contain, for example, couplers and DIR compounds or a color mixing inhibitor normally used.

As a plurality of silver halide emulsion layers constituting each unit light-sensitive layer, two or three layers having different sensitivities can be preferably used. In this case, layers are preferably arranged such that the sensitivity is sequentially decreased toward a support, and a non-light-sensitive layer may be formed between the silver halide emulsion layers. Alternatively, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/G/H/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having high sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted.

As described above, various layer arrangements and orders can be selected in accordance with an application of the light-sensitive material.

Although a silver halide amount for use in the present invention is particularly not limited, it is preferably 12 g/m$^2$ or less (silver amount), and more preferably, 8 g/m$^2$ or less.

The density of silver with respect to a gelatin binder is particularly not limited. However, silver is preferably used within the range of 0.01 to 5.0 as a silver amount (weight)/gelatin (weight) ratio in accordance with a high-sensitivity emulsion layer, a low-sensitivity emulsion layer, and the intended application.

The tabular grains of the present invention can be used together with non-tabular grains.

A preferable silver halide contained in grains other than the tabular grains of the present invention is silver iodobromide, silver iodochloride, or silver iodochlorobromide containing about 30 mol %, or less of silver iodide. Most preferably, silver iodobromide or silver iodochlorobromide containing about 2 to 25 mol %, of silver iodide is used.

The silver halide grains in the photographic emulsion may be grains having regular crystals such as cubic, octahedral, and tetradecahedral crystals, grains having irregular crystals such as spherical and tabular crystals, or grains having crystal defects such as a twinned face, or may take a composite form thereof.

The silver halide grains may be fine grains having a grain size of about 0.2 μm or less or large grains having a projected area diameter of about 10 μm, and the emulsion may be a polydisperse or monodisperse emulsion.

The silver halide emulsion which can be used in the present invention can be prepared by methods described in, for instance, Research Disclosure (RD) No. 17643 (December, 1978), PP. 22 and 23, "I. Emulsion preparation and types"; RD No. 18716 (November, 1979), page 648; P. Glafkides, "Chemic et Phisique Photograph-iquie", Paul Montel, 1967; G. F. Duffin, "Photographic Emulsion Chemistry", Focal Press, 1966; and V. L. Aelikman et al., "Making and Coating Photographic Emulsion", Focal Press, 1964.

Monodisperse emulsions described in U.S. Pat. Nos. 3,574,628 and 3,655,394 and British Patent 1,413,748 can preferably be used.

Tabular grains having an aspect ratio of about 5 or more can be used in the present invention. The tabular grains can be easily prepared by methods described in, for example, Gutoff, "Photographic Science and Engineering", Vol. 14, PP. 248 to 257, (1970); U.S. Pat. Nos. 4,434,226, 4,414,310, 4,433,048, and 4,439,520; and British Patent 2,112,157.

The crystal structure may be uniform, may consist of different halogen compositions in inner and outer portions, or may be a layered structure. In addition, a silver halide having a different composition may be bonded by an epitaxial junction, or a compound other than a silver halide such as silver rhodanate or zinc oxide may be bonded.

Also, a mixture of grains having various crystal shapes can be used.

The silver halide emulsion is normally subjected to physical ripening, chemical ripening, and spectral sensitization. Additives used in these processes are described in Research Disclosure Nos. 17643 and 18716, and they are summarized in the following table.

Known photographic additives which can be used together with the photographic emulsion of the present invention are also described in the above two Research Disclosures, and they are summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25<br>pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

In order to prevent degradation in photographic properties caused by formaldehyde gas, a compound which can react with and fix formaldehyde described in U.S. Pat. No. 4,411,987 or 4,435,503 is preferably added to the light-sensitive material.

Various color couplers can be used in present invention, and examples of these couplers are described in above-described Research Disclosure (RD), No. 17643, VII-C to VII-G as patent references.

Preferred examples of a yellow coupler are described in, for instance, U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, for example, U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 04795/88.

Examples of a cyan coupler are phenol and naphthol couplers, and preferably, those described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Disclosure 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler 10 having a dye precursor group which can react with a developing agent to form a dye as a split-off group described in U.S. Pat. No. 4,777,120 may be preferably used.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,221, 4,367,282, 4,409,320, and 4,576,910, and British Patent 2,102,173.

Couplers releasing a photographically useful residue upon coupling are preferably used in the present invention. DIR couplers, i.e., couplers releasing a development inhibitor described in the patents cited in the above-described Research Disclosure No. 17643, VII-F, JP-A-57-151944, JP-A-57-154234, JP-A-60-184248, JP-A-63-37346, and U.S. Pat. Nos. 4,248,962 and 4,782,012 are preferably used.

Preferable examples of a coupler imagewise releasing a nucleating agent or a development accelerator upon development are those described in British Patent 2,097,140, 2,131,188, and JP-A-59-157638 and JP-A-59-170840.

Examples of a coupler which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-60-24252; a coupler releasing a dye which turns to a colored form after being released described in EP 173,302A; bleaching accelerator releasing couplers described in, for example, RD. Nos. 11449 and 24241 and JP-A-61-201247; a legend releasing coupler described in, for example, U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced in the light-sensitive materials by various known dispersion methods.

Examples of a high-boiling solvent used in an oil-in-water dispersion method are described in, for example, U.S. Pat. No. 2,322,027.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, phenol, 4-chloro-3, 5-dimethylphenol, 2-phenoxyethanol, and 2-(4-thiazolyl-)benzimidazole described in JP-A-63-257747, JP-A-62-272248, and JP-A-1-80941.

The silver halide emulsion of the present invention can be contained in a silver halide emulsion layer of a photographic light-sensitive material having at least one silver halide emulsion layer on a support and can be applied to various types of color light-sensitive materials. Typical examples of the color light-sensitive material are a color negative film for a general purpose or a movie, a color reversal film for a slide or a television, color paper, a color positive film, and color reversal paper.

A support which can be suitably used in the present invention is described in, for example, RD. No. 17643, page 28 and RD. No. 18716, from the right column, page 647 to the left column, page 648.

In the light-sensitive material using the photographic emulsion of the present invention, the sum total of film thicknesses of all hydrophilic colloidal layers at the side having emulsion layers is preferably 23 μm or less, more preferably, 20 μm or less, and most preferably, 18 μm or less. A film swell speed $T_{1/2}$ is preferably 30 sec. or less, and more preferably, 20 sec. or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching 1/2 of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation of (maximum swell film thickness—film thickness)/film thickness.

The color photographic light-sensitive material according to the present invention can be developed by conventional methods described in RD. No. 17643, pp. 28 and 29 and RD. No. 18716, the left to right columns, page 615.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

A ratio ($cm^{-1}$) of a contact area with air with respect to a photographic processing solution ($cm^3$) in a processing tank, i.e., an aperture rate is preferably 0.1 or less, and more preferably, 0.001 to 0.05. In order to reduce the aperture rate, a shielding member such as a floating cover may be provided on the liquid surface of photographic processing solution in the processing tank. In addition, a method of using a movable cover described in JP-A-1-82033 or a slit developing method described in JP-A-63-216050 may be used. The aperture rate is preferably reduced in not only color and black-and-white development steps but also all subsequent steps, e.g., bleaching, bleach-fixing, fixing, washing, and stabilizing steps. In addition, the replenishing amount can be reduced by using a means for suppressing storage of bromide ions in a developing solution.

A color development time is normally set between 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the intended applications. Examples of the bleaching agent are a compound of a multivalent metal such as iron (III) and a peroxide. Typical examples of the bleaching agent are an organic complex salt of iron (III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid, or a complex salt of citric acid, tartaric acid or malic acid. Of these compounds, an iron (III) complex salt of aminopolycarboxylic acid such as an iron (III) complex salt of ethylenediaminetetraacetic acid and aniron (III) complex salt of 1,3-diaminopropanetetraacetic acid are preferred because they can increase the processing speed and prevent environmental contamination. The pH of the bleaching or bleach-fixing solution is normally 4.0 to 8. In order to increase the processing speed, however, processing can be performed at a lower pH.

A bleaching accelerator can be used in the bleaching solution, the bleach-fixing solution and their pre-bath, if necessary. These bleaching accelerators are effective especially in bleach-fixing of a photographic color light-sensitive material.

The bleaching solution or the bleach-fixing solution preferably contains, in addition to the above compounds, an organic acid in order to prevent a bleaching stain. A most preferably organic acid is a compound having an acid dissociation constant (pKa) of 2 to 5, e.g., acetic acid or propionic acid.

Examples of the fixing agent for use in a fixing solution or a bleach-fixing solution are a thiosulfate, a thiocyanate, a thioether-based compound, a thiourea and a large amount of an iodide. Of these compounds, a thiosulfate is generally used, and especially, ammonium thiosulfate can be used in a widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution. The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

An automatic developing machine for processing the light-sensitive material of the present invention preferably has a light-sensitive material conveying means described in JP-A-60-191257, JP-A-60-191258, or JP-A-60-101259. As described in JP-A-60-191257, this conveying means can significantly reduce carry-over of a processing solution from a pre-bath to a post-bath, thereby effectively preventing degradation in performance of the processing solution. This effect significantly reduces especially a processing time in each processing step and a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248–253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as sodium chlorinated isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bokabi Gakkai ed., "Dictionary of Antibacterial and Antifungal Agents" may be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes further performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct.

Various chelating agents or antifungal agents can be added in the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide light-sensitive material of the present invention can be applied to thermal development light-sensitive materials described in, for example, U.S. Pat. No. 4,500,626, JP-A-60-133449, JP-A-59-218443, JP-A-61-238056, and EP 210,660A2.

When the light-sensitive material of the present invention is to be used in the form of roll, it is preferably housed in a cartridge. A most general cartridge is the 135-format which is currently used. In addition, cartridges proposed in the following patent specifications can be used. (Unexamined Published Japanese Utility Model Application No. 58-67329, JP-A-58-181035, JP-A-58-182634, Unexamined Published Japanese Utility Model Application No. 58-195236, U.S. Pat. No. 4,221,479, JP-A-01-231045, JP-A-02-170156, Japanese Patent Application Nos. 63-183344, 1-21862, 1-25362, 1-30246, 1-20222, 1-21863, 1-37181, 1-33108, 1-85198, 1-172595, and 1-172594, and JP-A-02-124564, and U.S. Pat. Nos. 4,846,418, 4,848,693, and 4,832,275.)

The present invention will be described in more detail below by way of the following examples.

EXAMPLE 1

(1) Preparation of Emulsion

Emulsion A:

An aqueous solution obtained by dissolving 6 g of potassium bromide and 30 g of an inert gelatin in 3.7 l of distilled water was stirred, and 14% aqueous potassium bromide solution and 20% aqueous silver nitrate solution were added to the solution at a constant flow rates over one minute by a double jet method under the conditions of a temperature of 55° C. and a pBr of 1.0 (in this addition (I), 2.40% of the total silver amount was consumed). After an aqueous gelatin solution (17%, 300 cc) was added and the resultant solution was stirred at 55° C., a 20% aqueous silver nitrate solution was added at a constant flow rate until the pBr reached 1.40 (in this addition (II), 5.0% of the total silver amount was consumed). Thereafter, a 20% potassium bromide solution containing potassium iodide, and a 33% aqueous silver nitrate solution were added to the resultant solution by the double jet method over 80 minutes so that 8.3 g of potassium iodide were added (in this addition (III), 92.6% of the total silver amount were consumed). During the addition, the temperature was kept at 55° C. and the pBr was kept at 1.50. The silver nitrate amount used in this emulsion was 425 g. Subsequently, gold-sulfur sensitization was optimally performed after desalting was performed by a normal flocculation method, thereby preparing a tabular silver iodobromide emulsion A (AgI=2.0 mol %,) having an aspect ratio of 6.5 and a sphere-equivalent diameter of 0.8 μm as a comparative example.

Emulsion B:

A tabular silver iodobromide emulsion B (aspect ratio=6.3, sphere-equivalent diameter=0.8 μm) as a comparative example was prepared following the same procedures as for the emulsion A except that potassium iodide was removed from a halide solution used in addition (III) and addition of a solution containing 8.3 g of potassium iodide was performed by temporarily stopping addition of silver nitrate and potassium bromide solutions when 57% of the total silver amount were consumed during addition (III).

Emulsion C:

A tabular silver iodobromide emulsion C (aspect ratio=6.5, sphere-equivalent diameter=0.8 μm) as a comparative example was prepared following the same procedures as for the emulsion A except that $2\times10^{-5}$ mol/mol Ag of a compound 1-16 (listed in Table A to be presented later) were added when 20% of the total silver amount were consumed during addition (III).

Emulsion D1:

A tabular silver iodobromide emulsion D1 (aspect ratio=6.B, sphere-equivalent diameter=0.8 μm) of the present invention was prepared following the same procedures as for the emulsion B except that $2\times10^{-5}$ mol/mol Ag of hydrogen peroxide were added when 20% of the total silver amount were consumed during addition (III).

Emulsion D2:

A tabular silver iodobromide emulsion D2 (aspect ratio=6.5, sphere-equivalent diameter=0.8 μm) of the present invention was prepared following the same procedures as for the emulsion B except that $2\times10^{-5}$ mol/mol Ag of the compound 1-16 (listed in Table A to be presented later) were added when 20% of the total silver amount were consumed during addition (III)

(2) Observation of Dislocation of Grain

Direct observation of dislocations was performed for the emulsions A to D1 and D2 by using a transmission electron microscope described in this specification. JEM-2,000FX available from Nihon Denshi K.K. was used as an electron microscope, and observation was performed with a voltage of 200 kV at a liquid nitrogen temperature. No clear dislocations were found in the emulsions A and C. In the emulsions B, D1, and D2, however, a large number of dislocations were found in a grain from a position of 80% of a distance between the center and the edge of the grain to the edge, and grains containing 20 or more dislocations occupied 90% of the grains.

The emulsions A to D1 and D2 in amounts as listed in Table 1 were coated on triacetylcellulose film supports having undercoating layers.

TABLE 1

| Emulsion Coating Conditions | |
|---|---|
| (1) Emulsion Layer | |
| Emulsion . . . emulsions A to D1 and D2 (silver $2.1\times10^{-2}$ mol/m$^2$) | |
| Coupler ($1.5\times10^{-3}$ mol/m$^2$) | |

TABLE 1-continued

| Emulsion Coating Conditions | |
|---|---|
| 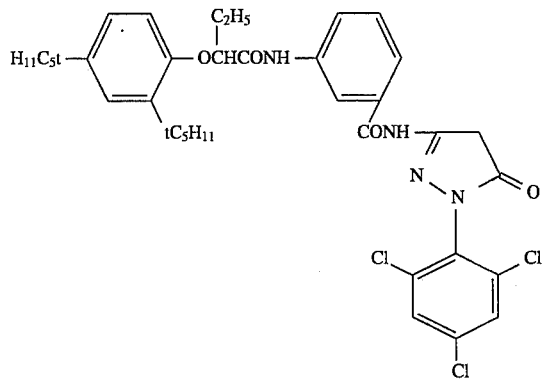 | |
| Tricresylphosphate | (1.10 g/m$^2$) |
| Gelatin | (2.30 g/m$^2$) |
| (2) Protective Layer | |
| 2,4-dichlorotriazine-6-hydroxy-s-triazine sodium salt | (0.08 g/m$^2$) |
| Gelatin | (1.80 g/m$^2$) |

After these samples were left to stand at a temperature of 40° C. and a relative humidity of 70%, the samples were wedge-exposed at 10 CMS for 1/100" and developed by the following processing solutions (Table 2), thereby measuring densities. In addition, pressure characteristics were tested as follows.

After each sample was left in an atmosphere at a relative humidity of 55% for three hours or more, a load of 4 g was applied to the sample in the same atmosphere by using a needle having a diameter of 0.1 mm, thereby scratching the emulsion surface at a speed of 1 cm/sec. After the sample was developed, its density was measured with an aperture having a diameter of 25 μm. The results are summarized in Table 3.

TABLE 2

Processing Method

| Process | Time | Temperature | Replenishing* Amount | Tank Volume |
|---|---|---|---|---|
| Color Development | 2 min. 45 sec. | 38° C. | 33 ml | 20 l |
| Bleaching | 6 min. 30 sec. | 38° C. | 25 ml | 40 l |
| Washing | 2 min. 10 sec. | 24° C. | 1,200 ml | 20 l |
| Fixing | 4 min. 20 sec. | 38° C. | 25 ml | 30 l |
| Washing (1) | 1 min. 05 sec. | 24° C. | Counter flow piping from (2) to (1) | 10 l |
| Washing (2) | 1 min. 00 sec. | 24° C. | 1,200 ml | 10 l |
| Stabilization | 1 min. 05 sec. | 38° C. | 25 ml | 10 l |
| Drying | 4 min. 20 sec. | 55° C. | | |

*A replenishing amount per meter of a 35-mm wide sample.

The compositions of the process solutions will be presented below.

| | Mother Solution (g) | Replenishment Solution (g) |
|---|---|---|
| Color Developer: | | |
| Diethylenetriamine-pentaacetate | 1.0 | 1.1 |
| 1-hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-ethyl-N-β-hydroxylethylamino]-2-methylalinine Sulfate | 4.5 | 5.5 |
| Water to make | 1.0 l | 1.0 l |
| pH | 10.05 | 10.10 |
| Bleaching Solution: | | |
| Ferric Sodium Ethylenediamine-tetraacetate Trihydrate | 100.0 | 120.0 |
| Disodium Ethylene-diaminetetraacetate | 10.0 | 11.0 |
| Ammonium Bromide | 140.0 | 160.0 |
| Ammonium Nitrate | 30.0 | 35.0 |
| Ammonia Water (27%) | 6.5 ml | 4.0 ml |
| Water to make | 1.0 l | 1.0 l |
| pH | 6.0 | 5.7 |
| Fixing Solution: | | |
| Disodium Ethylene-diaminetetraacetate | 0.5 | 0.7 |
| Sodium Sulfite | 7.0 | 8.0 |
| Sodium Bisulfite | 5.0 | 5.5 |
| Ammonium Thiosulfate Aqueous Solution (70%) | 170.0 ml | 200.0 ml |
| Water to make | 1.0 l | 1.0 l |
| pH | 6.7 | 6.6 |
| Stabilizing Solution: | | |
| Formalin (37%) | 2.0 ml | 3.0 ml |
| Polyoxyethylene-p-monononylphenylether (average polymerization degree = 10) | 0.3 | 0.45 |
| Disodium Ethylene-diaminetetraacetate | 0.05 | 0.08 |
| Water to make | 1.0 l | 1.0 l |
| pH | 5.0–8.0 | 5.0–8.0 |

TABLE 3

| Emulsion | Sensitivity* | Fog Increase Caused By Scratching | Remarks |
|---|---|---|---|
| A | 100 | 0.20 | Comparative Example |
| B | 120 | 0.20 | Comparative Example |
| C | 96 | 0.08 | Comparative Example |
| D1 | 108 | 0.08 | Present Invention |
| D2 | 120 | 0.08 | Present Invention |

*Sensitivity is represented by a relative value of a reciprocal of an exposure amount for giving a density of fog + 0.2.

As is apparent from Table 3, the emulsions D1 and D2 of the present invention have high sensitivity and a high resistance to pressure. Note that the emulsions A and B were prepared by the method described in JP-A-63-220228.

EXAMPLE 2

Emulsions E to I were prepared as follows.

Emulsion E: In the method of preparing the emulsion D2, the compound 1-16 was changed to a compound 1-3 ($6\times10^{-5}$ mol/mol Ag).

Emulsion F: In the method of preparing the emulsion D2, the compound 1-16 was changed to a compound 2-4 ($6\times10^{-5}$ mol/mol Ag).

Emulsion G: In the method of preparing the emulsion E, the addition amount of the compound 1-3 was changed to $3\times10^{-4}$ mol/mol Ag.

Emulsion H: In the method of preparing the emulsion E, the addition amount of the compound 1-3 was changed to $1\times10^{-2}$ mol/mol Ag.

Emulsion I: In the method of preparing the emulsion E, the timing of adding the compound 1-3 was changed to a timing when 60% of the total silver amount were consumed during addition (III).

Coated samples of the emulsions E to I were formed to check photographic sensitivity and pressure characteristics following the same procedures as in Example 1. The results are summarized in Table 4.

TABLE 4

| Emulsion | Sensitivity | Fog Increase Caused by Scratching | Compound | Addition Amount (mol/mol Ag) | Addition* Timing | Ratio of Grains Containing 20 or More Dislocations | Remarks |
|---|---|---|---|---|---|---|---|
| A | 100 | 0.20 | — | — | — | 0% | Comparative Example |
| E | 118 | 0.09 | 1-3 | $6\times10^{-5}$ | 20% | 90% or more | Present Invention |
| F | 118 | 0.13 | 2-4 | $6\times10^{-5}$ | 20% | 90% or more | Present Invention |
| G | 113 | 0.07 | 1-3 | $3\times10^{-4}$ | 20% | 90% or more | Present Invention |
| H | 100 | 0.05 | 1-3 | $1\times10^{-2}$ | 20% | 90% or more | Present Invention |
| I | 109 | 0.11 | 1-3 | $6\times10^{-5}$ | 60% | 90% or more | Present Invention |

*"Addition Timing" is a time when x% of the total silver amount was consumed.

As is apparent from Table 4, when the addition amount was increased, a resistance to pressure was increased though photographic sensitivity was slightly decreased. Also, when an addition position was present more inside a grain, a resistance to pressure was effectively increased, and the photographic sensitivity was not decreased.

EXAMPLE 3

In the preparation method of the emulsion A of Example 1, an amount of potassium bromide and an amount of gelatin in the reactor vessel before silver nitrate was added, a temperature, and an addition time of addition (I) were adjusted to prepare tabular grains J to M having different aspect ratios as listed in Table 5. In the preparation method of the emulsion D2 of Example 1, parameters similar to those described above were adjusted to prepare tabular grains N to Q as listed in Table 5.

Pressure characteristics were checked following the same procedures as in Example 1. The results are summarized in Table 5.

As is apparent from Table 5, although the effect of the present invention (i.e., producing less pressure marks) was obtained regardless of an aspect ratio, the effect is significant especially in the emulsions N to P.

TABLE 5

| Emulsion | Average Aspect Ratio | Circle-Equivalent Diameter (μm) | Ratio of Grains Containing 20 or more Dislocations | Fog Increase Caused by Scratching | Remarks |
|---|---|---|---|---|---|
| J | 4.1 | 0.5 | 0% | 0.15 | Comparative Example |
| K | 7.0 | 0.8 | 0% | 0.20 | Comparative Example |
| L | 10.5 | 1.0 | 0% | 0.23 | Comparative Example |
| M | 20.1 | 1.7 | 0% | 0.30 | Comparative Example |
| N | 3.9 | 0.5 | 90% or more | 0.10 | Present Invention |
| O | 6.8 | 0.8 | 90% or more | 0.10 | Present Invention |
| P | 10.4 | 1.0 | 90% or more | 0.16 | Present Invention |
| Q | 19.2 | 1.7 | 90% or more | 0.24 | Present Invention |

EXAMPLE 4

Potassium bromide and gelatin in the reactor vessel of the emulsion A of Example 1, a temperature, and an addition time were adjusted to prepare emulsions R and S. The preparation method of the emulsion D2 was similarly adjusted to prepare emulsions T and U. The characteristics of the emulsions R to U are summarized in Table 6.

In addition, emulsions as listed in Table 7 were prepared.

TABLE 6

| Emul-sion | Aspect Ratio | Circle-Equivalent Diameter | Ratio of Grains Containing 20 or More Dislocations | Remarks |
|---|---|---|---|---|
| R | 7.8 | 0.8 μm | 0% | Emulsion as Comparative Example |
| S | 5.7 | 1.1 μm | 0% | Emulsion as Comparative Example |
| T | 7.6 | 0.8 μm | 90% or more | Emulsion of Present Invention |
| U | 6.1 | 1.05 μm | 90% or more | Emulsion of Present Invention |

TABLE 7

| Emulsion No. | Average AgI Content (%) | Average Grain Size (μ) | Variation Coefficient of Grain Size (%) | Diameter/ Thickness Ratio | Silver Amount Ratio (AgI content %) |
|---|---|---|---|---|---|
| Emulsion ① | 4.0 | 0.45 | 27 | 1 | Core/Shell = 1/3(13/1), Double-Structured Grain |
| Emulsion ② | 8.9 | 0.70 | 14 | 1 | Core/Shell = 3/7(25/2), Double-Structured Grain |
| Emulsion ③ | 10 | 0.75 | 30 | 2 | Core/Shell = 1/2(24/3), Double-Structured Grain |
| Emulsion ④ | 16 | 1.05 | 35 | 2 | Core/Shell = 4/6(40/0), Double-Structured Grain |
| Emulsion ⑤ | 10 | 1.05 | 35 | 3 | Core/Shell = 1/2(24/3), |

TABLE 7-continued

| Emulsion No. | Average AgI Content (%) | Average Grain Size (μ) | Variation Coefficient of Grain Size (%) | Diameter/ Thickness Ratio | Silver Amount Ratio (AgI content %) |
|---|---|---|---|---|---|
| Emulsion ⑥ | 4.0 | 0.25 | 28 | 1 | Double-Structured Grain Core/Shell = 1/3(13/1), |
| Emulsion ⑦ | 14.0 | 0.75 | 25 | 2 | Double-Structured Grain Core/Shell = 1/2(42/0), |
| Emulsion ⑧ | 14.5 | 1.30 | 25 | 3 | Double-Structured Grain Core/Shell = 37/63(34/3), |
| Emulsion ⑨ | 1 | 0.07 | 15 | 1 | Double-Structured Grain Homogeneous Grain |
| Emulsion ⑩ | 5 | 0.90 | 30 | 2 | Core/Shell = 1/1(10/0), |
| Emulsion ⑪ | 7 | 1.50 | 25 | 2 | Double-Structured Grain Core/Shell = 1/1(14/0), Double-Structured Grain |

A plurality of layers having the following compositions were formed on undercoated triacetylcellulose film supports by using the emulsions listed in Tables 6 and 7, thereby preparing samples 101 to 104 as multi-layered color light-sensitive materials. (Compositions of Light-Sensitive Layers)

Numerals corresponding to the respective components indicate coating amounts in units of g/m$^2$. The silver halide is represented in a silver-converted coated amount. A coating amount of the sensitizing dye is represented in units of mols per mol of the silver halide in the same layer.

| (Samples 101 to 104) | |
|---|---|
| Layer 1: Antihalation Layer | |
| Black Colloid Silver | silver 0.18 |
| Gelatin | 1.40 |
| Layer 2: Interlayer | |
| 2,5-di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Layer 3: Donor Layer Having Interlayer Effect on Red-Sensitive Layer | |
| Emulsion ⑧ | silver 1.2 |
| Emulsion ⑨ | silver 2.0 |
| Sensitizing Dye IV | $4 \times 10^{-4}$ |
| EX-10 | 0.10 |
| HBS-1 | 0.10 |
| HBS-2 | 0.10 |
| Layer 4: Interlayer | |
| EX-5 | 0.040 |
| HBS-1 | 0.020 |
| Gelatin | 0.80 |
| Layer 5: 1st Red-Sensitive Emulsion Layer | |
| Emulsion ① | silver 0.25 |
| Emulsion ② | silver 0.25 |
| Sensitizing Dye I | $1.5 \times 10^{-4}$ |
| Sensitizing Dye II | $1.8 \times 10^{-5}$ |
| Sensitizing Dye III | $2.5 \times 10^{-4}$ |
| EX-2 | 0.335 |
| EX-10 | 0.020 |
| U-1 | 0.07 |
| U-2 | 0.05 |

-continued

| (Samples 101 to 104) | |
|---|---|
| U-3 | 0.07 |
| HBS-1 | 0.060 |
| Gelatin | 0.87 |
| Layer 6: 2nd Red-Sensitive Emulsion Layer | |
| Emulsion ⑦ | silver 1.0 |
| Sensitizing Dye I | $1.0 \times 10^{-4}$ |
| Sensitizing Dye II | $1.4 \times 10^{-5}$ |
| Sensitizing Dye III | $2.0 \times 10^{-4}$ |
| EX-2 | 0.400 |
| EX-3 | 0.050 |
| EX-10 | 0.015 |
| U-1 | 0.07 |
| U-2 | 0.05 |
| U-3 | 0.07 |
| Gelatin | 1.30 |
| Layer 7: 3rd Red-Sensitive Emulsion Layer | |
| Emulsion ④ | silver 1.60 |
| Sensitizing Dye I | $1.0 \times 10^{-4}$ |
| Sensitizing Dye II | $1.4 \times 10^{-5}$ |
| Sensitizing Dye III | $2.0 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| Layer 8: Interlayer | |
| EX-5 | 0.040 |
| HBS-1 | 0.020 |
| Gelatin | 0.80 |
| Layer 9: 1st Green-Sensitive Emulsion Layer | |
| Emulsion ① | silver 0.15 |
| Emulsion ② | silver 0.15 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| Sensitizing Dye IV | $5.0 \times 10^{-5}$ |
| EX-6 | 0.260 |
| EX-1 | 0.021 |
| EX-7 | 0.030 |
| EX-8 | 0.005 |
| HBS-1 | 0.100 |
| HBS-3 | 0.010 |
| Gelatin | 0.63 |
| Layer 10: 2nd Green-Sensitive Emulsion Layer | |
| Emulsion listed in Table 8 | silver 0.45 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| Sensitizing Dye IV | $5.0 \times 10^{-5}$ |

-continued

| (Samples 101 to 104) | |
|---|---|
| EX-6 | 0.094 |
| EX-22 | 0.018 |
| EX-7 | 0.026 |
| HBS-1 | 0.160 |
| HBS-3 | 0.008 |
| Gelatin | 0.50 |
| Layer 11: 3rd Green-Sensitive Emulsion Layer | |
| Emulsion ⑤ | silver 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| Sensitizing Dye IV | $0.5 \times 10^{-5}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Layer 12: Yellow Filter Layer | |
| Yellow Colloid Silver | silver 0.05 |
| EX-5 | 0.08 |
| HBS-1 | 0.03 |
| Gelatin | 0.95 |
| Layer 13: 1st Blue-Sensitive Emulsion Layer | |
| Emulsion ① | silver 0.08 |
| Emulsion ② | silver 0.07 |
| Emulsion ⑥ | silver 0.07 |
| Sensitizing Dye VIII | $3.5 \times 10^{-4}$ |
| EX-9 | 0.721 |
| EX-8 | 0.042 |
| HBS-1 | 0.28 |
| Gelatin | 1.10 |
| Layer 14: 2nd Blue-Sensitive Emulsion Layer | |
| Emulsion listed in Table 8 | silver 0.45 |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| Layer 15: 3rd Blue-Sensitive Emulsion Layer | |
| Emulsion ⑧ | silver 0.77 |
| Sensitizing Dye VIII | $2.2 \times 10^{-4}$ |
| EX-9 | 0.20 |
| HBS-1 | 0.07 |
| Gelatin | 0.69 |
| Layer 16: 1st Protective Layer | |
| Emulsion ⑨ | silver 0.20 |
| U-4 | 0.11 |
| U-5 | 0.17 |
| HBS-1 | 0.05 |
| Gelatin | 1.00 |
| Layer 17: 2nd Protective Layer | |
| Polymethylacrylate Grains (diameter = about 1.5 μm) | 0.54 |
| S-1 | 0.20 |
| Gelatin | 1.20 |

In addition to the above components, a gelatin hardener H-1, EX-14 to 21, and a surfactant were added to each layer. Formulas of the compounds which are used are listed in Table B to be presented later.

TABLE 8

| Sample | Layer 10 | Layer 14 |
|---|---|---|
| 101 | Emulsion ③ | Emulsion R |
| 102 | Emulsion ③ | Emulsion T |
| 103 | Emulsion S | Emulsion ⑦ |
| 104 | Emulsion U | Emulsion ⑦ |

Pressure characteristics of the samples 101 to 104 were tested. Density measurement of a scratched portion was performed by using blue and green filters. Development was performed by the method shown in Table 2 of Example 1 by setting a color development time to be 3 minutes and 15 seconds. The test results of the pressure characteristics are summarized in Table 9.

In the samples 102 and 104 using the emulsions of the present invention, a fog caused by scratching was reduced.

TABLE 9

| Sample | Fog Increase Caused by Scratching (Magenta) | Fog Increase Caused by Scratching (Yellow) | Remarks |
|---|---|---|---|
| 101 | 0.02 | 0.12 | Comparative Example |
| 102 | 0.02 | 0.06 | Present Invention |
| 103 | 0.08 | 0.06 | Comparative Example |
| 104 | 0.03 | 0.06 | Present Invention |

TABLE A

| | |
|---|---|
| (1-1) | $CH_3SO_2SNa$ |
| (1-2) | $C_2H_5SO_2SNa$ |
| (1-3) | $C_3H_7SO_2SK$ |
| (1-4) | $C_4H_9SO_2SLi$ |
| (1-5) | $C_6H_{13}SO_2SNa$ |
| (1-6) | $C_8H_{17}SO_2SNa$ |
| (1-7) | $CH_3(CH_2)_3CH(C_2H_5)CH_2SO_2S.NH_4$ |
| (1-8) | $C_{10}H_{21}SO_2SNa$ |
| (1-9) | $C_{12}H_{25}SO_2SNa$ |
| (1-10) | $C_{16}H_{33}SO_2SNa$ |
| (1-11) | $(CH_3)_2CH-SO_2SK$ |
| (1-12) | $t-C_4H_9SO_2SNa$ |
| (1-13) | $CH_3OCH_2CH_2SO_2S.Na$ |

TABLE A-continued
(1-14)
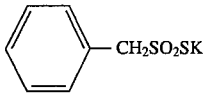
(1-15) $CH_2{=}CHCH_2SO_2SNa$
(1-16)
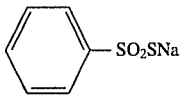
(1-17)
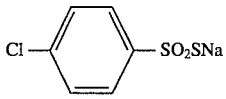
(1-18)
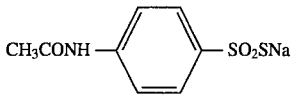
(1-19)
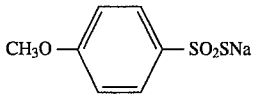
(1-20)
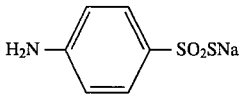
(1-21)
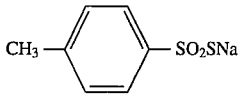
(1-22)
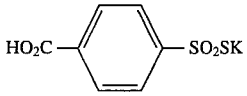
(1-23)
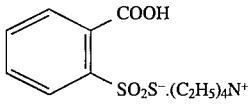
(1-24)
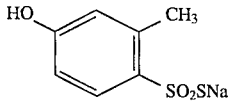
(1-25)
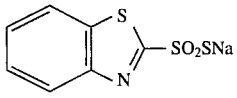
TABLE A-continued
(1-26)
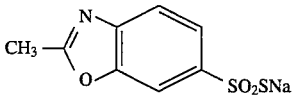
(1-27)
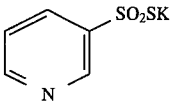
(1-278)
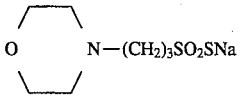
(1-29) $KSSO_2(CH_2)_2SO_2SK$
(1-30) $NaSSO_2(CH_2)_4SO_2SNa$
(1-31) $NaSSO_2(CH_2)_4S(CH_2)_4SO_2SNa$
(1-32)
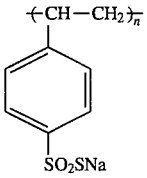
(1-33)
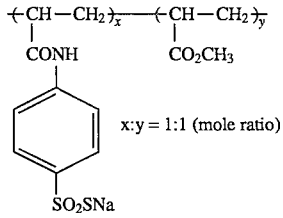
x:y = 1:1 (mole ratio)
(2-1) $C_2H_5SO_2SCH_3$
(2-2) $C_8H_{17}SO_2SCH_2CH_3$
(2-3)
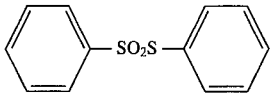
(2-4)
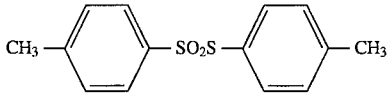
(2-5) $C_2H_5SO_2SCH_2CH_2CN$ TABLE A-continued
(2-6)
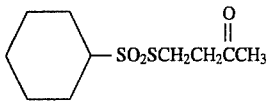
(2-7)
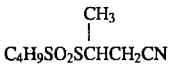
(2-8)
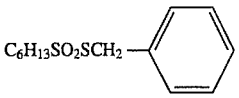
(2-9)
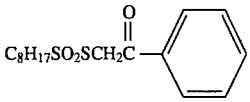
(2-10)
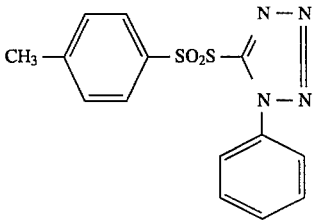
(2-11)
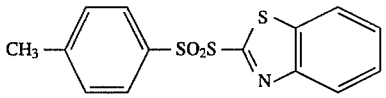
(2-12)
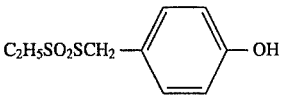
(2-13)
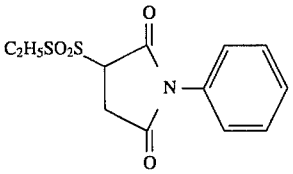
(2-14)
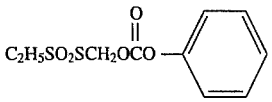
(2-15)
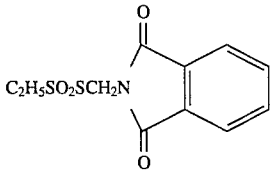
TABLE A-continued
(2-16)
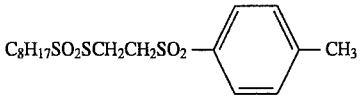
(2-17)
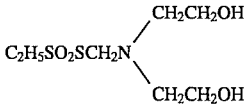
(2-18)
$C_2H_5SO_2SCH_2CH_2CH_2CH_2OH$
(2-19)
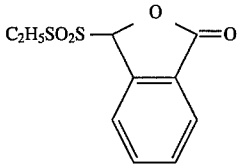
(2-20)
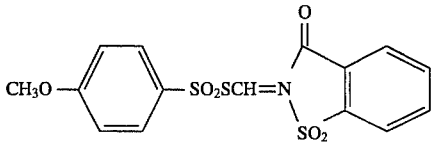
(2-21)
$CH_3SSO_2(CH_2)_4SO_2SCH_3$
(2-22)
$CH_3SSO_2(CH_2)_2SO_2SCH_3$
(2-23)
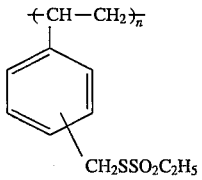
(2-24)
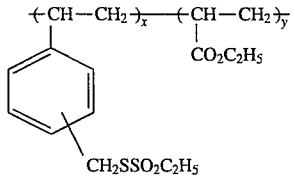
x:y =2:1 (mole ratio)
(2-25)
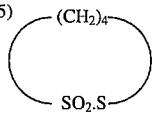
(3-1)
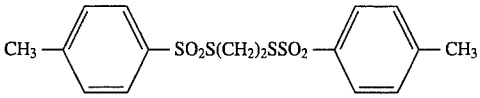

TABLE A-continued
(3-2)
$C_2H_5SO_2SCH_2CH_2SO_2CH_2CH_2SSO_2C_2H_5$
(3-3)
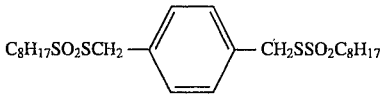
(3-4)
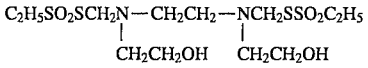
(3-5)
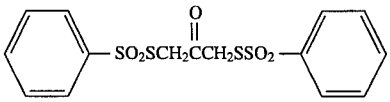
TABLE A-continued
(3-6)
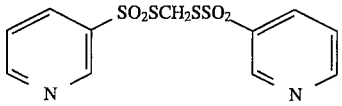
(3-7)
$C_2H_5SO_2SSSO_2C_2H_5$
(3-8)
(n)$C_3H_7SO_2SSSO_2C_3H_7$(n)
(3-8)
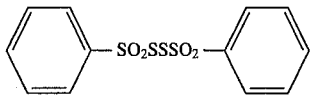
TABLE B
EX-1
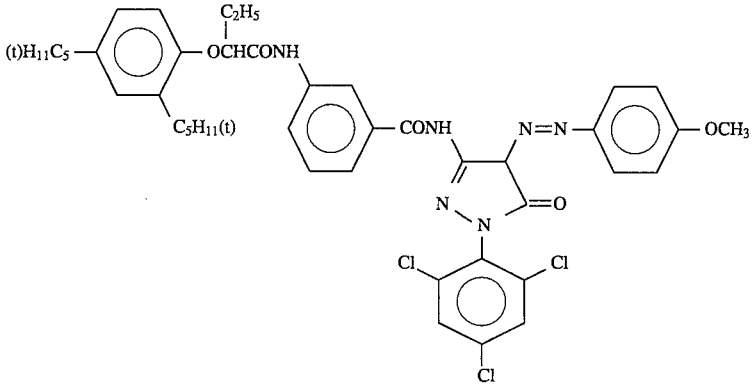
EX-2
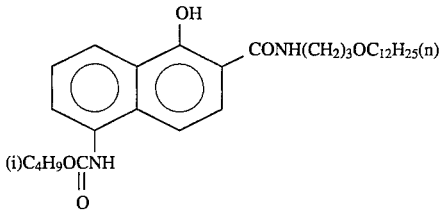
EX-3
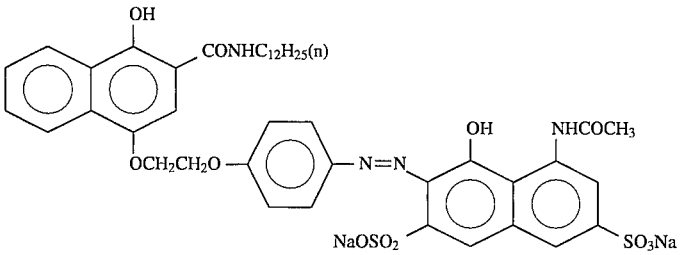
EX-4
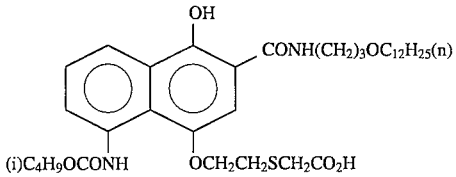

TABLE B-continued
EX-5
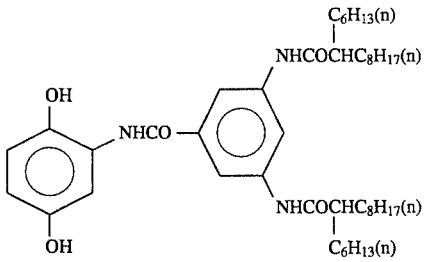
EX-6
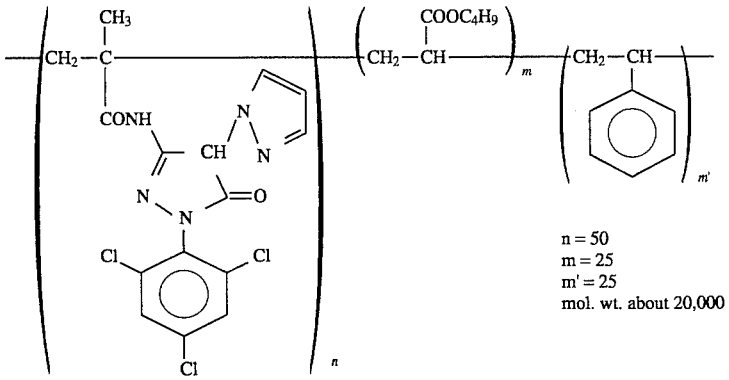
EX-7
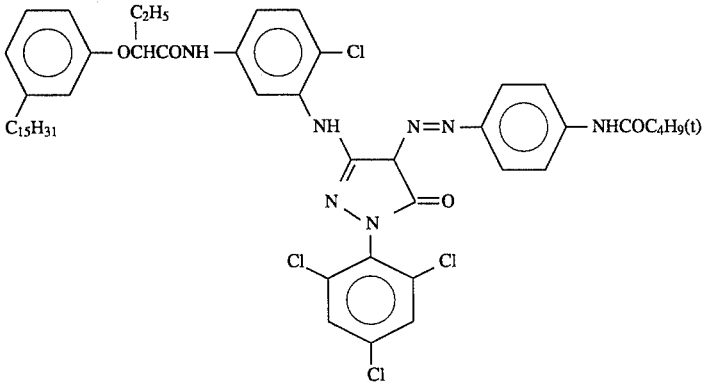
EX-8
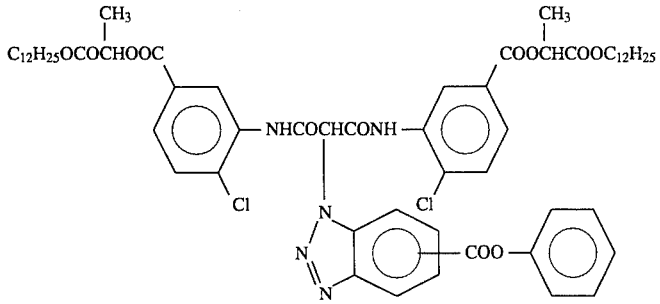
EX-9
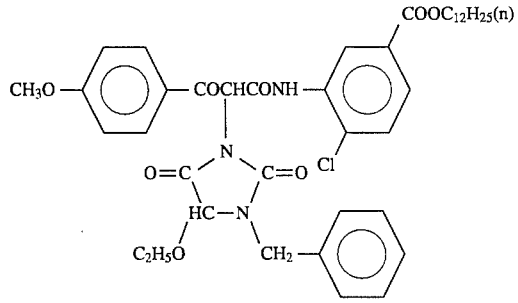

TABLE B-continued
EX-10
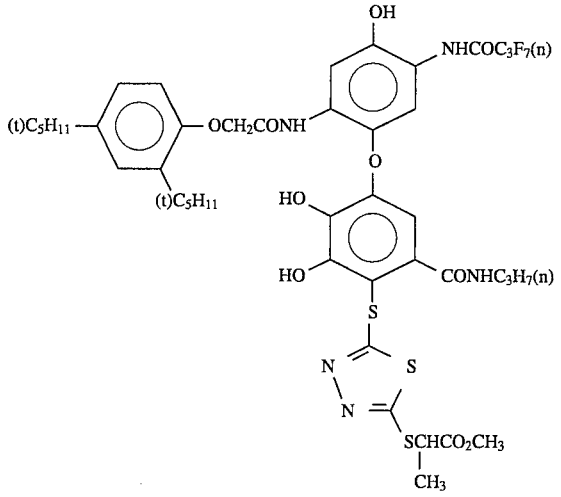
EX-11
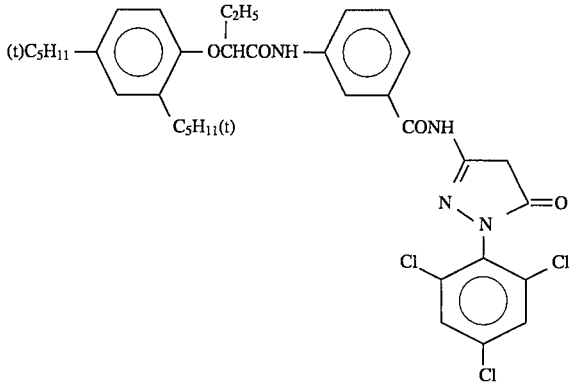
EX-12
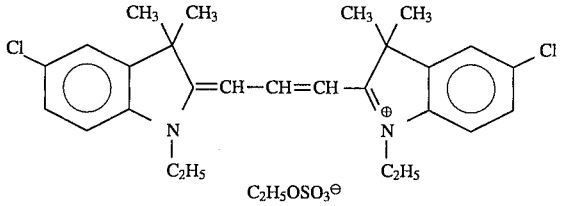
EX-13
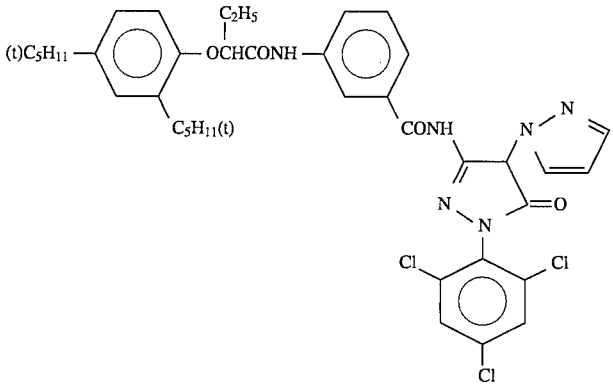

TABLE B-continued
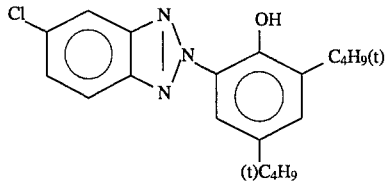
U-1
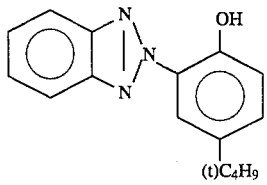
U-2
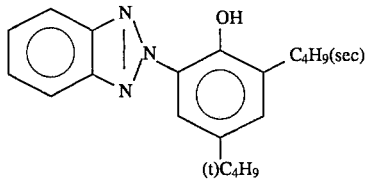
U-3
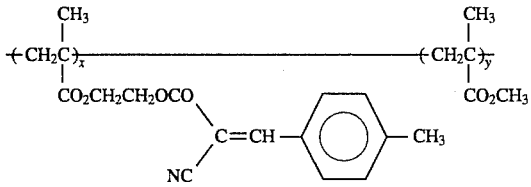
x:y = 70:30 (wt%)
U-4
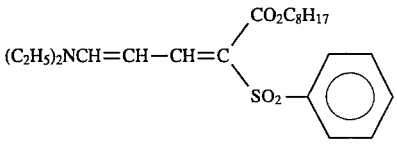
UV-5
tricresy phosphate HBS-1
di-n-buthyl phthalate HBS-2
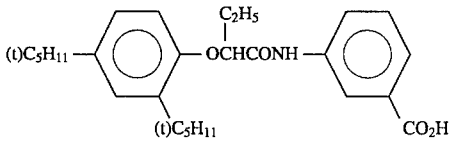
HBS-3
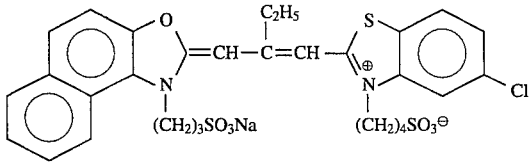
Sensitizing dye I
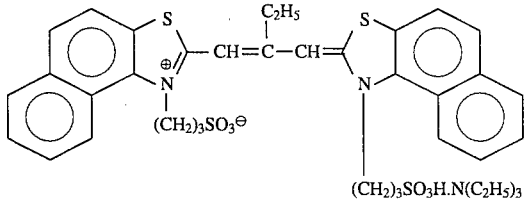
Sensitizing dye II TABLE B-continued
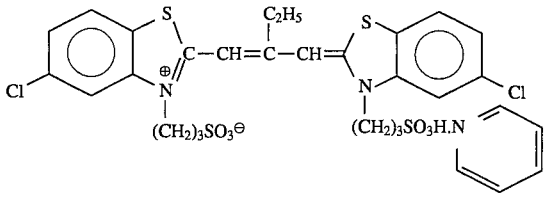
Sensitizing dye III
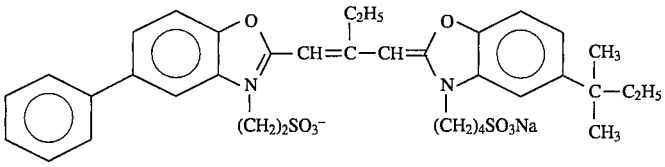
Sensitizing dye IV
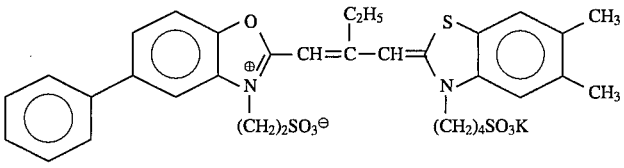
Sensitizing dye V
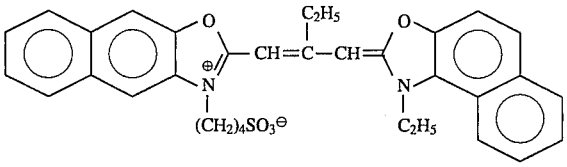
Sensitizing dye VI
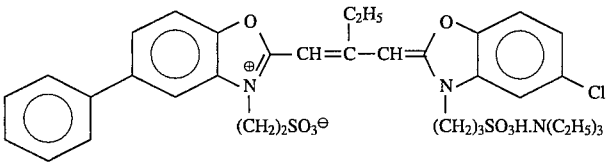
Sensitizing dye VII
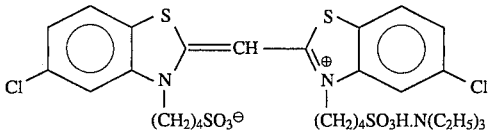
Sensitizing dye VIII
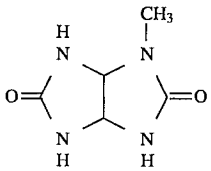
S-1
$CH_2=CH-SO_2-CH_2-CONH-CH_2$
$CH_2=CH-SO_2-CH_2-CONH-CH_2$
H-1
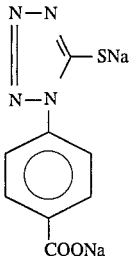
EX-14

TABLE B-continued

| | |
|---|---|
| 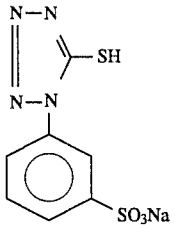 | EX-15 |
| copolymer of polyvinyl pyrrolidone and polyvinylalchol | EX-16 |
| 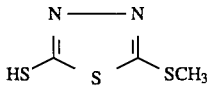 | EX-17 |
| 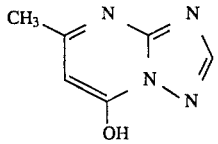 | EX-18 |
| 1, 2-benzisothiazoline-3-one | EX-19 |
| n-butyl-p-hydroxybenzoate | EX-20 |
| 2-phenoxy ethanol | EX-21 |
| 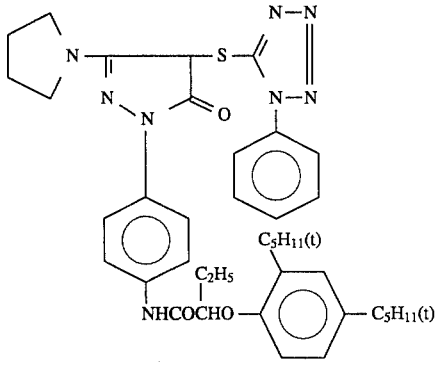 | EX-22 |

What is claimed is:

1. A negative silver halide emulsion comprising silver halide grains in a dispersion medium, wherein said silver halide grains are tabular silver halide grains having a thickness of less than 0.5 μm, a diameter of not less than 0.3 μm, an aspect ratio of not less than 2, and not less than 10 dislocations per grain account for not less than 50% of a projected area of all the silver halide grains; wherein said tabular silver halide grains comprise a substrate region having an AgI content of 0 to 12 mole %, an outer region having an AgI content of 0 to 12 mole %, and an internal high AgI region located between the substrate region and the outer region, obtained by growing AgI, or AgBrI having an AgI content of 10 to 40 mole %, wherein the AgI content of said internal high AgI region is higher than the AgI content of said substrate region and said outer region; and wherein said grains are formed in the presence of a compound represented by formula (I) which is added during grain formation and before completion of addition of a total amount of solution of water-soluble silver salt necessary to complete silver halide grain formation:

$$R—SO_2SM \quad (I)$$

wherein R represents an unsubstituted or substituted aliphatic group, an unsubstituted or substituted aromatic group, or an unsubstituted or substituted heterocyclic group, and M represents a cation, wherein said compound represented by formula (I) may be a polymer containing divalent groups derived from structures represented by formula (I) as repeating units.

2. The negative silver halide emulsion according to claim 1, wherein said water-soluble silver salt is $AgNO_3$.

3. A photographic light-sensitive material having at least one negative silver halide emulsion layer on a support, wherein said negative silver halide emulsion layer comprises a silver halide emulsion comprising tabular silver halide grains having a thickness of less than 0.5 μm, a diameter of not less than 0.3 μm, an aspect ratio of not less than 2, and not less that 10 dislocations per grain account for not less than 50% of a projected area of all the silver halide grains; wherein said tabular silver halide grains comprise a substrate region having an AgI content of 0 to 12 mole %, an outer region having an AgI content of 0 to 12 mole %, and an internal high AgI region located between the substrate region and the outer region, obtained by growing AgI, or AgBrI having an AgI content of 10 to 40 mole %, wherein the AgI content of said internal high AgI region is higher than the AgI content of said substrate region and said outer region; and wherein said grains are formed in the presence of at least one compound represented by formula (I) which is added during grain formation and before completion of addition of a total amount of solution of water-soluble silver salt necessary to complete silver halide grain formation:

$$R—SO_2SM \quad (I)$$

wherein R represents an unsubstituted or substituted aliphatic group, an unsubstituted or substituted aromatic group, or an unsubstituted or substituted heterocyclic group, and M represents a cation, wherein said compound represented by formula (I) may be a polymer containing divalent groups derived from structures represented by formula (I) as repeating units.

4. The silver halide photographic light-sensitive material according to claim 3, wherein said tubular grains having not less than 10 dislocations per grain account for not less than 80% of a projected area of all the silver halide grains.

5. The silver halide photographic light-sensitive material according to claim 4, wherein said internal high AgI region comprises an annular region about a grain center, the annular region having a silver iodide content higher than an average silver iodide content of said grain, and the annular region defined by a line around the grain center enclosing 5 mol % of the silver amount and a line around the grain center enclosing 80 mol % of the silver amount.

6. The silver halide photographic light-sensitive material according to claim 3, wherein an aspect ratio of said tabular grains is less than 8.

7. The silver halide photographic light-sensitive material according to claim 6, wherein a compound represented by formula (I) is added during grain formation and before two thirds of the total water-soluble silver salt necessary to complete silver halide grain formation, has been added.

8. The silver halide photographic light-sensitive material according to claim 6, wherein a compound represented by formula (I) is added during grain formation and before one third of the total water-soluble silver salt necessary to complete silver halide grain formation has been added.

9. The silver halide photographic light-sensitive material according to claim 6, wherein said emulsion is spectrally sensitized by a methine dye.

10. The silver halide photographic light-sensitive material according to claim 3, wherein said silver halide photographic light-sensitive material is a silver halide color photographic light-sensitive material.

11. The silver halide photographic light-sensitive material according to claim 10, wherein said emulsion is spectrally sensitized by a methine dye.

12. The silver halide photographic light-sensitive material according to claim 3, wherein said aspect ratio is from 2 to 12.

13. The silver halide photographic light-sensitive material according to claim 3, wherein said diameter of the silver halide grains is from 0.3 to 4 μm and said grain thickness is from 0.05 to 0.5 μm.

14. The silver halide photographic light-sensitive material according to claim 3, wherein R is an aliphatic group selected from the group consisting of an alkyl group having 1 to 22 carbon atoms, an alkenyl group having 2 to 22 carbon atoms and an alkynyl group.

15. The silver halide photographic light-sensitive material according to claim 3, wherein R is an aromatic group having from 6 to 20 carbon atoms.

16. The silver halide photographic light-sensitive material according to claim 3, wherein R is a 3 to 15 membered heterocyclic ring having at least one element selected from the group consisting of nitrogen, oxygen, sulfur, selenium and tellurium.

17. The silver halide photographic light-sensitive material according to claim 3, wherein substituents of R are selected from the group consisting of an alkyl group, an alkoxy group, an aryl group, a hydroxy group, a halogen atom, an aryloxy group, an alkylthio group, an arylthio group, an acyl group, a sulfonyl group, an acylamino group, a sulfonylamino group, an acyloxy group, a carboxyl group, a cyano group, a sulfo group and an amino group.

18. The silver halide photographic light-sensitive material according to claim 3, wherein the compound of formula (I) is present in an amount of $10^{-7}$ to $10^{-1}$ mol/mol Ag per mol of silver halide.

19. The silver halide photographic light-sensitive material according to claim 3, wherein said water-soluble silver salt is $AgNO_3$.

* * * * *